US006311417B1

(12) United States Patent
Pratt

(10) Patent No.: US 6,311,417 B1
(45) Date of Patent: Nov. 6, 2001

(54) EXCAVATOR BUCKET ASSEMBLY

(75) Inventor: Samuel S. Pratt, Cumberland, MD (US)

(73) Assignee: Rockland, Inc., Bedford, PA (US)

( * ) Notice: Subject to any disclaimer, the term of this patent is extended or adjusted under 35 U.S.C. 154(b) by 0 days.

(21) Appl. No.: 09/481,249

(22) Filed: Jan. 11, 2000

(51) Int. Cl.[7] ..... E02F 3/96
(52) U.S. Cl. ..... 37/404; 37/454
(58) Field of Search ..... 37/232, 241, 903, 37/403, 404, 408, 410, 468, 454; 172/777, 784, 797, 772.5, 699

(56) References Cited

U.S. PATENT DOCUMENTS 3,596,996 * 8/1971 Carter ..... 37/403
3,702,712 * 11/1972 Cairns, III ..... 37/404
3,778,111 * 12/1973 Ciofani ..... 172/777 X
4,041,624 * 8/1977 Fryrear ..... 37/117.5
4,204,348 * 5/1980 Lydie ..... 37/117.5
5,197,212 * 3/1993 Vail ..... 37/403
5,456,028 * 10/1995 Larson ..... 37/404
6,023,863 * 2/2000 Mahin ..... 37/404

* cited by examiner

*Primary Examiner*—Robert E. Pezzuto
(74) *Attorney, Agent, or Firm*—Lalos & Keegan

(57) ABSTRACT

A bucket assembly mountable on the handle of an excavator machine and the like generally consisting of a bucket; a pair of ripper teeth mounted on the bucket for pivotal movement about a common axis; abutment surfaces disposed on the bucket for restricting the angular displacement of the ripper teeth between storage positions and operative positions; and devices for retaining the ripper teeth in their stored and operative positions, operable upon causing portions of such ripper teeth to engage the ground and the bucket to pivot in a selected direction relative to the handle, to release the ripper teeth.

27 Claims, 4 Drawing Sheets

EXCAVATOR BUCKET ASSEMBLY

This invention relates to an excavator bucket assembly and more particularly a bucket assembly which may be utilize in a conventional manner to scoop comparatively loose soils and in a modified manner to loosen and scoop, hard, compacted or rocky soils.

BACKGROUND OF THE INVENTION

In digging most soils with a conventional excavating bucket, teeth formed on the bottom cutting blade of the bucket usually are sufficient to penetrate and loosen most soils for easy scooping. In digging harder, compacted or rocky soils, the use of such teeth for penetrating and loosening the soil often may not be feasible because of the inability of such teeth to penetrate a hard soil surface, undue wear on the teeth or excessive time and energy required in a digging cycle, decreasing productivity and correspondingly increasing cost. To overcome such deficiencies in conventional excavating buckets, it has been the practice to loosen such hard soil with the use of one or more ripper teeth either mounted separately on the handle of a machine or mounted on and working in conjunction with a conventional excavating bucket. Having such ripper teeth mounted on an excavating bucket results in greater productivity. However, such bucket mounted ripper teeth in the prior art have not been found to be most advantageously designed so as to provide a compact and efficient assembly for operating such buckets either in the conventional manner or in a modified manner in which the soil is first ripped to loosen it and then scooped by the bucket. It thus is the principal object of the present invention to provide an assembly including an excavator bucket and at least one ripper tooth mounted on the bucket, in which such assembly may be used selectively in a conventional manner to penetrate and scoop loose soil and in a modified manner to penetrate, loosened and scoop hard soil.

SUMMARY OF THE INVENTION

The present invention overcomes a number of the shortcomings of bucket assemblies in the prior art intended to penetrate, loosen and scoop hard surface soils by providing a bucket assembly mountable on the handle of an excavating machine and the like, generally consisting of a pair of transversally spaced side walls and an upper wall; a rear wall merging with a lower wall, cooperating with the upper and side walls to define a bucket provided with a material receiving opening; means mounted on the upper wall for pivotally connecting the bucket to the handle of the machines; at least, one ripper tooth connected to at least one of the walls of the bucket for pivotal movement about an axis disposed substantially parallel to the axis of the pivotal connection of the bucket to the handle; means mounted on at least one of the walls of the bucket for restricting the angular displacement of the ripper tooth between a storage position and an operative position; and means for retaining the ripper tooth in at least one of such positions, operable upon causing a portion of the ripper tooth to engage a stationery object such as the ground, and the bucket to pivot in a selected direction relative to the handle, to release the ripper tooth from it storage position and allow it to swing freely to its operative position. Preferably, a pair of such ripper teeth is provided and each such ripper teeth have a configuration and mounting on the bucket so that when the ripper teeth are disposed in their storage positions, they will be confined to a sufficient extent within the envelope of the bucket so that they will not interfere with the conventional use of the bucket, and when such ripper teeth are in their operative positions, they will project beyond the envelope of the bucket to freely engage, penetrate and loosen hard, compacted or rocky soil by manipulation of the handle and the bucket of the machine by the machine operator. Such ripper teeth further are provided with pointed protrusions engageable with a stationery object such as the ground when the ripper teeth are in their stored positions so that when the handle and the bucket of the machine are suitably manipulated, the engagement of such protrusion with such stationery object will cause the ripper teeth to become released from their retaining means and freely swing to their operative positions where they will again be retained to permit their use in penetrating and loosening hard soil materials.

BRIEF DESCRIPTIONS OF THE DRAWINGS

Figure 6:
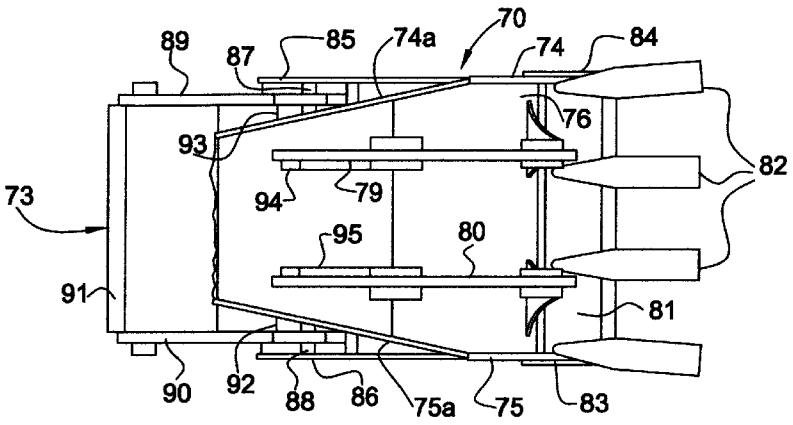
FIG. 6 is a top plan view of a bucket assembly consisting of another embodiment of the invention.
Figure 7:
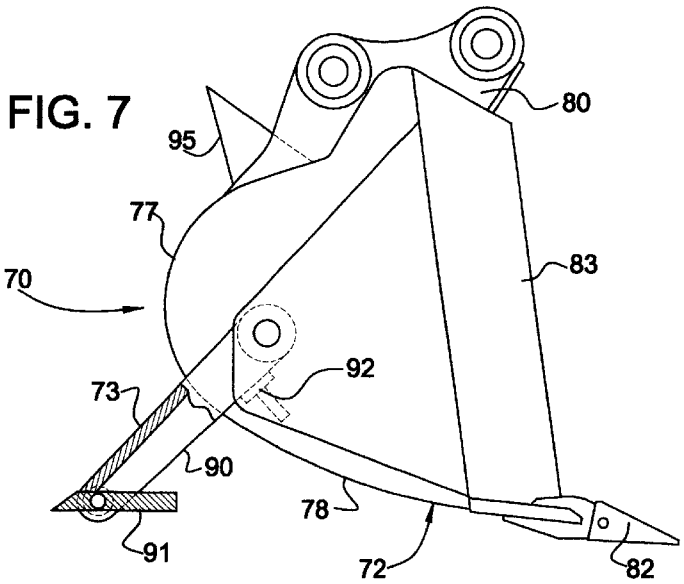
FIG. 7 is a side elevational view of the bucket assembly shown in FIG. 6, illustrating a ripper implement thereof disposed in its operative position.
Figure 8:
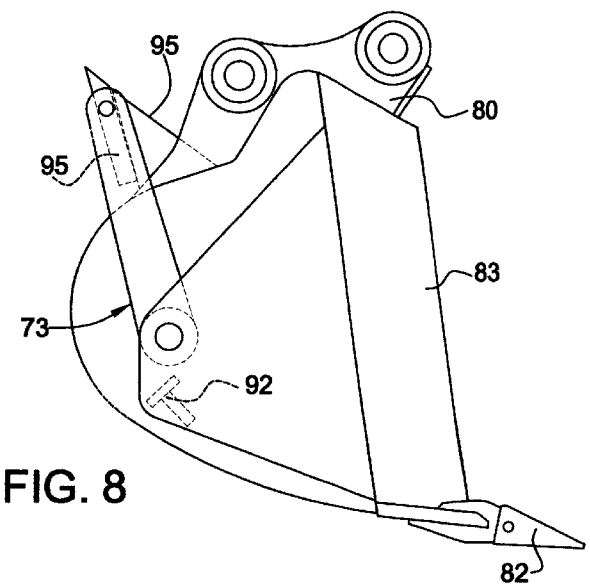
FIG. 8 is a view similar to the view shown in FIG. 7, illustrating the ripper implement in its stored position.
Figure 11:
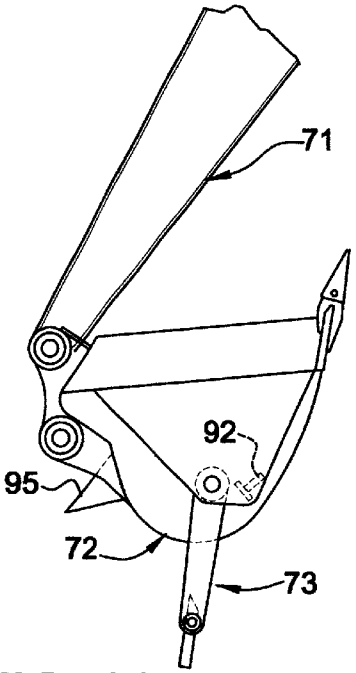
Figure 12:
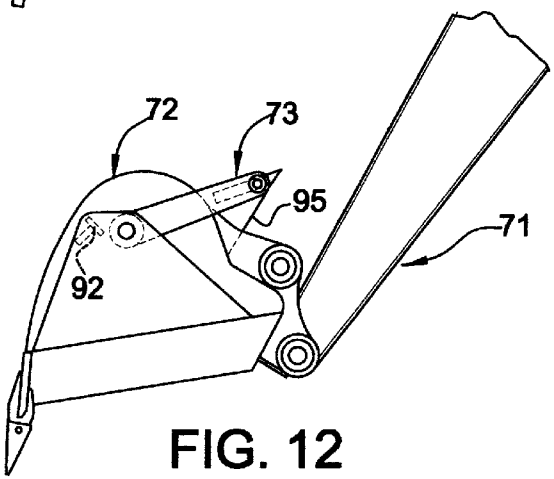
Figure 9:
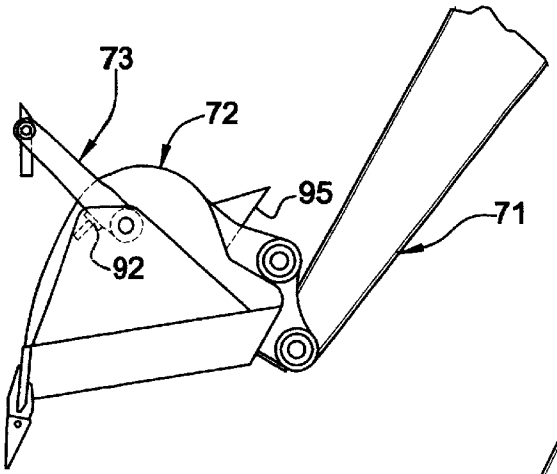
Figure 10:
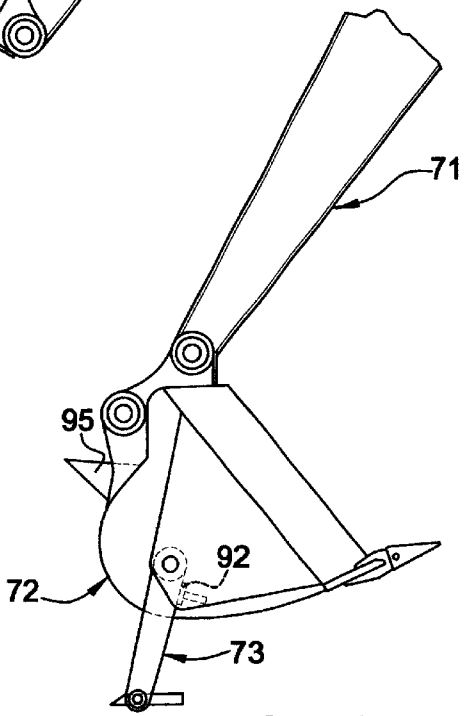

FIGS. 9 through 11 are side elevational views of the bucket assembly shown in FIGS. 6 through 8, illustrating the positions of the bucket and the attached ripper implement in a sequence of positions in utilizing the ripper implement; and FIG. 12 is a side elevational view of the bucket assembly shown in FIGS. 6 through 8 illustrating the bucket in its fully curled position and the ripper implement thereof in its stored position.

DESCRIPTION OF THE PREFERRED EMBODIMENTS OF THE INVENTION

Referring to FIGS. 1 through 5 of the drawings, there is illustrated a first embodiment of the invention consisting of a bucket assembly 20 shown mounted on a handle 21 of a conventional excavator machine. Handle 21 is pivotally connected at an upper end to the upper end of a boom of the excavator machine, and is provided with a conventional actuating assembly 22. Such assembly includes a cylinder member 23 pivotally connected to a bracket 24 mounted on an upper side of handle 21 by means of a connecting pin 25, and a rod member 26 pivotally connected at its free end to a support link 27 and an actuating link 28 by means of a connecting pin 29. In the conventional manner, the base end of support link 27 is pivotally connected to handle 21 by means of a connecting pin 30.

Figures 1, 2, 5:
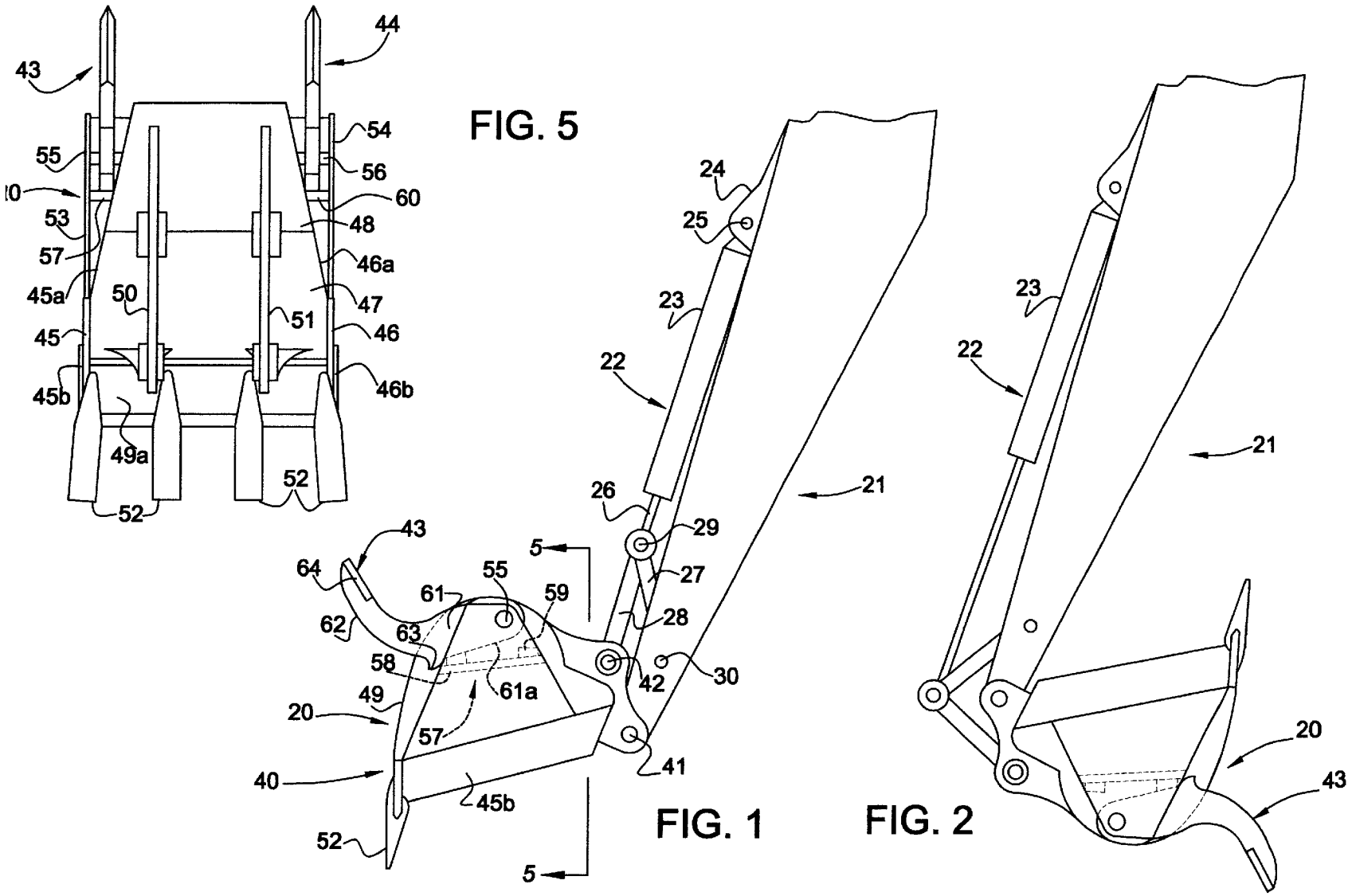
FIG. 1 is a side elevational view of a bucket assembly embodying the present invention mounted on the handle of an excavating machine, illustrating the ripper teeth of the assembly disposed in their operative positions and the bucket disposed in a fully uncurled position.
FIG. 2 is a view similar to the view shown in FIG. 1, illustrating the ripper teeth in their operative positions and the bucket in its fully curled position.
FIG. 5 is an enlarged cross-sectional view taken along line 5—5 in FIG. 1.

As best shown in FIGS. 1 and 5, bucket assembly 20 consists of a bucket 40 pivotally connected to the free end of handle 21 by means of a connecting pin 41, and also pivotally connected to actuating link 28 by means of a connecting pin 42, and a pair ripper teeth 43 and 44 pivotally connected to the bucket. The bucket includes a pair of transversely spaced, substantially parallel side walls 45 and 46 provided with rearwardly converging sections 45*a* and 46*a* and an upper wall section 47, a curved rear wall section 48 forming a continuation of the upper wall and a curved bottom wall 49 forming a continuation of the rear wall, interconnecting side walls 45 and 46. Upper wall 47 is provided with a pair of transversely spaced, parallel brackets 50 and 51 which are provided with two sets of openings for receiving connecting pins 41 and 42 therethrough. The front ends of side walls 45 and 46 terminate in a pair of leading cutting edges 45*b* and 46*b*, and the leading edge of bottom wall 49 terminates in a cutting edge 49*a* supporting a set of transversely spaced digging teeth 52

Secured to side walls 45 and 46 and extending rearwardly therefrom and substantially in longitudinal alignment therewith is a pair of side wall section 53 and 54 which are spaced from side wall sections 45*a* and 46*a*. Spanning and rigidly connected to side wall sections 45*a* and 53 is a pin 55. Similarly, spanning and rigidly connected to side wall sections 46*a* and 54 is a pin 56 aligned transversely with pin 59. Also spanning and rigidly connected to side wall sections 45*a* and 53 is a support plate member 57 on which there is mounted a pair of spaced abutment pads 58 and 59. Support plate member 57 is radially spaced from and disposed substantially parallel to the axis of pin 55, and abutment pads 58 and 59 are disposed on opposite sides of a plane disposed radially relative to such axis. Also spanning and rigidly connecting side wall sections 46*a* and 54 is a support plate member 60 comparable to support plate's member 57 and provided with a pair of transversely spaced abutment pads comparable to abutment pads 58 and 59.

Figure 4:
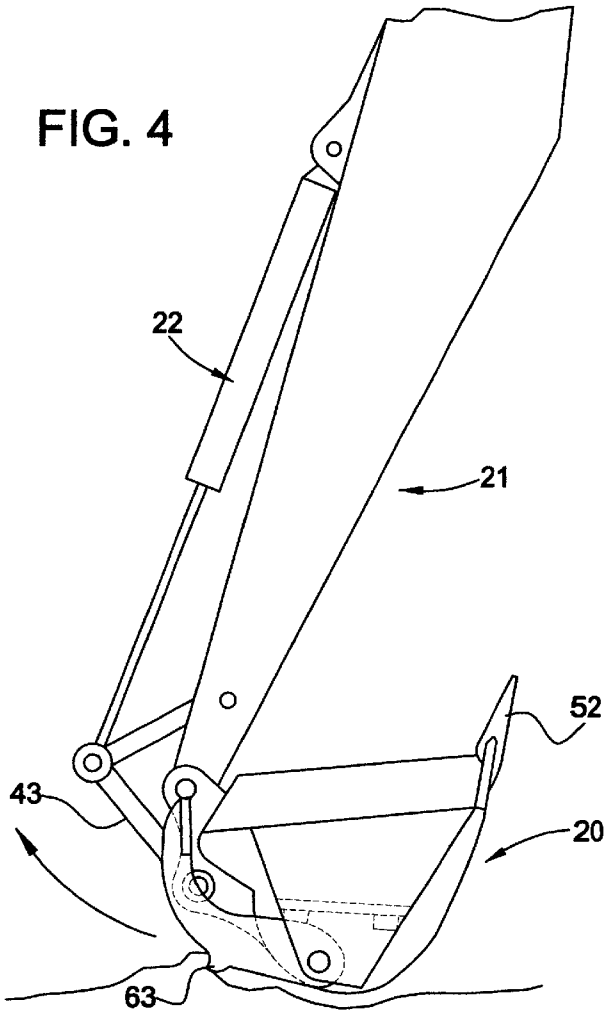
FIG. 4 is a view similar to the view shown in FIG. 1, illustrating the ripper teeth in their stored positions and the bucket in a curled position about to be uncurled and thus cause the release of the ripper teeth from their stored positions.
Figure 3:
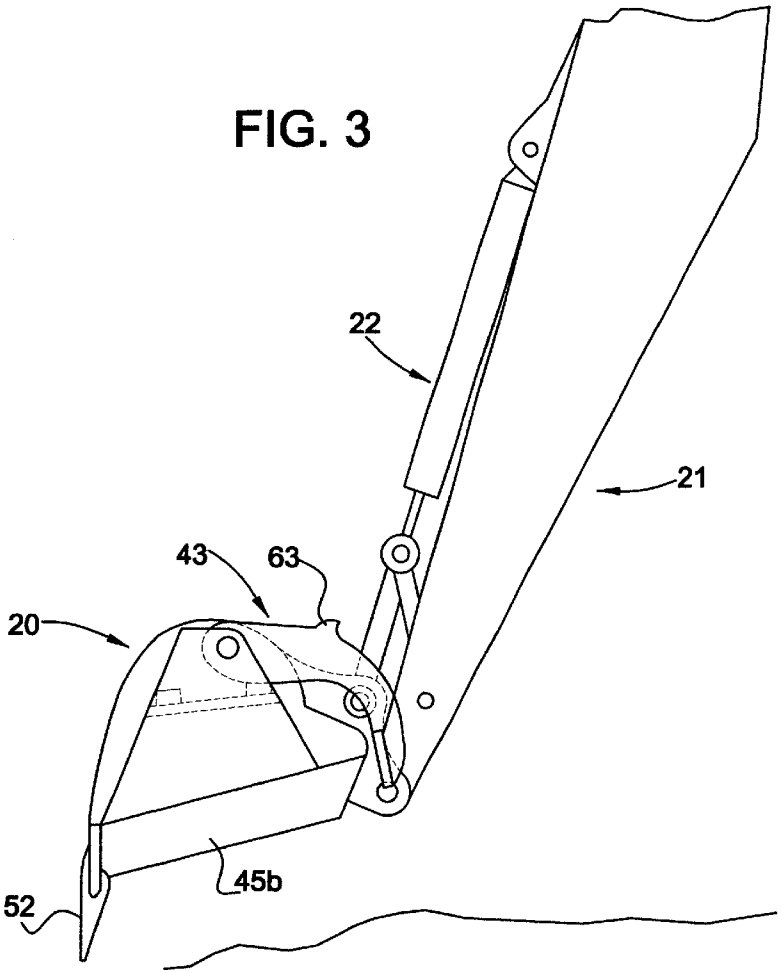
FIG. 3 is a view similar to the view shown in FIG. 1, illustrating the ripper teeth in their stored positions and the bucket in its fully uncurled position.

Ripper tooth 43 includes a shank section 61 and a curved, projecting tooth section 62. Shank section 61 includes a first side edge 61*a* which is adapted to engage abutment pad 58 when the ripper tooth is in the operative position as shown in FIGS. 1 and 2, and a side edge 61b which is adapted to engage abutment pad 59 when the ripper tooth is in the stored position as shown in FIGS. 3 and 4. Ripper tooth 43 is free to pivot about the axis of pin 55 through an arc of approximately 180°, restricted at each end of such angular displacement by engagement of the side edges thereof with abutment pads 58 and 59. When in either the operative position as shown in FIGS. 1 and 2 or the stored position as shown in FIGS. 3 and 4, the ripper tooth is releaseability retained in such positions by means of a suitable releasable retaining means such as a permanent magnet, a latch device or a spring biased device. Shank portion 61 further is provided with a pointed, protruding portion 63 disposed ahead of side edge 61*a* which functions to facilitate the release of the ripper tooth when in the stored position as will later be described, and curved, projecting portion 62 is provided with a sharpened edge 64. Ripper tooth 44 is similar in construction to ripper tooth 43 and similarly has a shank portion with side edges engageable with a pair of abutment pads comparable to abutment pads 58 and 59 which are engaged by such side shank surfaces when the ripper tooth is in the operative and stored positions, and comparable retaining means. It further includes a pointed, protruding portion comparable to protruding portion 63 of ripper tooth 43, and a sharpened edge comparable to edge 64.

Ripper teeth 43 and 44 are displaceable, independent of each other. Each may be displaced between its operative and stored position independent of the other ripper tooth or both may be displaced in unison between such positions depending on the manner in which the handle and bucket is maneuvered by the operator of the machine.

Normally, the ripper teeth will be disposed in their stored positions as shown in FIGS. 3 and 4 with the teeth disposed adjacent to the upper wall of the bucket, clear of the rear and bottom walls of the bucket to permit the bucket to be operated in the conventional manner to penetrate and scoop materials. In such use, the teeth provided on the front cutting blade of the bucket usually are sufficient to penetrate and loosen soil being excavated so that it may easily be received within the bucket. The positioning of the pivot axis of the ripper teeth, their curved configurations and their spacing to opposite sides of the free end of the handle permit the bucket to be curled and uncurled in the conventional manner in performing a digging cycle without interfering with such cycle. The ripper teeth in the stored positions are releaseably retained and confined within an envelope of the bucket extending a small amount above the upper wall of the bucket. The releasable retaining means consisting of permanent magnets, latch devices or spring biased devices are mounted on the rear or upper walls of the bucket adjacent to the abutment stops. Disposed within side wall sections 53 and 54, such devices will be shielded and thus protected during normal operation of bucket.

Whenever the machine operator encounters hard or rocky soil which may not be readily penetrated and loosened by use of bucket teeth 52, the ripper teeth may be deployed from their storage to their operative positions to penetrate and loosened such soil merely by first manipulating the handle and bucket of the machine to cause the pointed, projecting portions on the outer sides of the ripper teeth to engage the ground as shown in FIG. 4, and then pivoting the handle upwardly while uncurling the bucket to thus cause the ripper teeth to pivot in a counter-clockwise direction relative to FIG. 4, about the common axis of pins 55 and 56, from their stored positions to their operative positions as shown in FIGS. 1 and 2. As the bucket thus uncurls, the pointed, protruding portions on the outer sides of the ripper teeth will act as fulcrums, causing the ripper teeth to overcome the retaining forces of the permanent magnets or other retaining devices. As the ripper teeth thus angularly displace through an arc of approximately 180°, they will engage the second set of abutment stops and there be acted upon by the second set of retaining means to thus releaseably retain the ripper teeth in their operative positions. The bucket assembly will then be configured to permit the assembly to be used to penetrate and loosen hard or rocky soil by means of the ripper teeth.

When it then is desired to reposition the ripper teeth to their stored positions and perhaps continue the use of the bucket in the conventional manner, the handle and the bucket may be maneuvered to cause the ends or outer sides of the ripper teeth to engage the ground, and then the handle may be pivoted upwardly while the bucket is curled to cause the ripper teeth to become released from their operative positions and angularly displaced to their stored positions, and be retained in such positions by means of the other set of retaining means. The operation of the bucket in the conventional manner may then be resumed. While the ripper teeth are in their operative positions as shown in FIGS. 1 and 2, it will be appreciated that hard or rocky soil may be penetrated and loosened merely by initially positioning the bucket in the position as shown in FIG. 2 and then curling the bucket to cause the ripper teeth to displace angularly and engage the soil as the bucket sweeps along the ground.

FIGS. 6 through 8 illustrate another embodiment of the present invention. The embodiment consists of a bucket assembly 70 mountable on a handle 71 of an excavating machine, comparable to previously described handle 21. The bucket assembly consists of a bucket 72 and a cutting implement 73. The bucket includes a pair of transversely spaced, substantially parallel side walls 74 and 75 having rearwardly converging sections 74*a* and 75*a*, an upper wall 76, a curved rear wall 77 forming a continuation of the upper wall and curved bottom wall 78 forming a continuation of the rear wall, interconnecting the side walls to provide a material receiving opening. The upper wall is provided with a pair of transversely spaced brackets 79 and 80 comparable to previously described brackets 50 and 51 for mounting the bucket assembly on handle 71 as in the previously described embodiment, the bottom wall terminates in a forwardly disposed cutting edge 81 provided with a plurality of transversely spaced bucket teeth 82 and the forwardly disposed ends of the side walls terminate in cutting edges 83 and 84. As in the previously described embodiment, a pair of rearwardly projecting plate members 85 and 86 are secured to the side walls of the bucket and are spaced from side wall sections 74*a* and 75*a*, respectively, and are connected to such side wall sections by means of a pair of transversely aligned pins 87 and 88.

Cutting implement 73 consists of a pair of arm members 89 and 90 and a blade member 91. The inner ends of arm numbers 89 and 90 are pivotally connected to pins 87 and 88, respectively, and blade member 91 is pivotally connected to the free ends of arm members 89 and 90 for pivotal movement about a common transverse axis. As best shown in FIGS. 6 and 7, the upper sides of the arm members are sharpened to provide cutting edges and the leading edge of blade member 91 also is sharpened to provide a leading cutting edge. The cutting implement is adapted to be positioned in an operative position as shown in FIG. 7 and an inoperative position as shown in FIG. 8. When in the operative position, the arms of the implement are caused to engage abutment pads 92 and 93 supported on the bucket side walls adjacent pins 87 and 88, and when in the stored position, blade member 91 of the cutting implement is caused to engage abutment plates 94 and 95 rigidly mounted on the upper wall of the bucket. The engageable surfaces of abutment pads 92 and 93 and abutment plates 94 and 95 are displaced approximately 100° apart through which are the implement swings in being displaced between its operative and stored positions. Disposed adjacent such abutments are releasable retaining means in the forms of permanent magnets, latching devices and spring biased retaining devices.

As with the previously described embodiment, with the cutting implement in the storage position as shown in FIG. 8, the bucket may be used in the conventional manner to perform conventional digging operations, and with the cutting implement in the operative position as shown in FIG. 7, the bucket assembly may be used either to break up hard or rocky soil or possibly to sever root systems of trees being felled or stumps being removed. It will be appreciated that with cutting edges along arm members 89 and 90 and blade member 91, root systems of trees will be severed on three sides thus facilitating the felling of trees and the removal of tree stumps.

The cutting implement may be displaced from the stored position shown in FIG. 8 to the operative position shown in FIG. 7 in essentially the same manner as described in connection with the first embodiment. The handle and bucket of the machine may be manipulated to curl the bucket and lower the handle so that the cutting edge of blade member 91 engages the ground. With the blade member thus forced against the ground, the handle may be pivoted upwardly and the bucket curled to cause the cutting implement to break free of the retaining device and allow it to swing down to the operative position where the arm members will then engage abutment pads 92 and 93 and be held by the releasable restraining means disposed adjacent to the abutment pads.

FIG. 11 illustrates the bucket in a fully curled position with the cutting implement released from the retaining means disposed adjacent abutment plates 94 and 95 and the cutting implement swung down and suspended from the bucket. FIG. 10 illustrates the bucket having curled to cause the cutting implement to engage abutment pads 92 and 93. FIG. 9 illustrates the bucket in the ally uncurled position with the cutting implement firmly held against abutment pads 92 and 93, in the operative position.

With the bucket curled and the cutting implement in the operative position, the bucket may be uncurled and curled to either penetrate and break up the ground, or penetrate the ground and sever the root system of a tree being felled or a stump being uprooted. The cutting implement may be displaced to the storage position simply by uncurling the bucket just above the ground so that the bucket will clear the ground and the implement will engage the ground, thus freeing the cutting implement from engagement with abutment pads 92 and 93 and causing it to engage abutment plates 94 and 95 where it will be retained by the associated retaining means.

In both embodiments, the buckets may be formed of cast steel, fabricated steel or a combination cast and fabricated steel. Preferably, the bucket teeth and cutting edges, and the ripper teeth and cutting implement are formed of a high tensile steel. In addition, it is preferred that the ripper teeth and the arm members of the cutting implement be positioned adjacent the side walls of the bucket, and that the mounting brackets also be positioned as close to the side walls of the buckets as practical so that loads transmitted between the ripper teeth or the arm members of the cutting instrument, and the handle of the machine will be transmitted directly without imposing any undue stresses on any transfer components of the buckets.

From the foregoing detail description, it will be evident that there are a number of changes, adaptations and modifications of the present invention which come within the province of those persons having ordinary skill in the art to which the aforementioned invention pertain. However, it is intended that all such variations not departing from the spirit of the invention be considered as within the scope thereof as limited solely by the appended claims.

I claim:

1. In a machine having a handle, a bucket assembly mountable on said handle, comprising:

pair of transversely spaced side walls;

an upper wall;

a rear wall merging with a lower wall, cooperating with said upper and side walls to define a bucket provided with a material receiving opening;

means mounted on said upper wall for pivotally connecting said assembly to said handle;

at least one ripper tooth connected to at least one of said walls for pivotal movement about an axis disposed substantially parallel to the axis of the pivotal connection of said bucket assembly to said handle;

means mounted on at least one of said walls for restricting the angular displacement of said ripper tooth between a stored position and an operative position; and means for retaining said ripper tooth in at least one of said positions, operable upon causing a portion of said ripper tooth to engage a stationery object and said bucket to pivot in a selected direction relative to said handle, to release said ripper tooth from said retaining means.

2. An assembly according to claim 1 wherein said restricting means comprises abutment surfaces engaged by said ripper tooth.

3. A bucket assembly according to claim 2 wherein said abutment surfaces are positioned relative to each other to permit an angular displacement of said ripper tooth within an arc of 180°.

4. A bucket assembly according to claim 2 wherein said ripper tooth includes a shank section pivotally connected to said at least one wall, engageable with said abutment surfaces, and a curved end section projecting beyond said bucket when said ripper tooth is disposed in said operative position.

5. A bucket assembly according to claim 1 wherein said releasable retaining means comprises a magnetic device.

6. A bucket assembly according to claim 1 wherein said releasable retaining means comprises a permanent magnet supported on said bucket.

7. A bucket assembly according to claim 1 wherein said releasable retaining means comprises a latch device.

8. A bucket assembly according to claim 1 wherein said releasable retaining means comprises a spring biased device.

9. A bucket assembly according to claim 1 wherein said ripper tooth includes a protrusion disposed on a side thereof engageable with a stationery object when said ripper tooth is in its stored position and said bucket is pivoted relative to said handle, to cause said ripper tooth to be angularly displaced out of its stored position.

10. A bucket assembly according to claim 9 wherein said protrusion converges to a point enabling it to firmly engage said stationery object and correspondingly cause said ripper tooth to release from said retaining means.

11. A bucket assembly according to claim 1 wherein said ripper tooth is pivotally connected to a side wall of said bucket.

12. A bucket assembly according to claim 11 wherein a portion of at least one of said side walls of said bucket converges inwardly and rearwardly, including a plate member rigidly mounted on said side wall and spaced from said converging portion thereof and a pin interconnecting said converging portion of said side wall and said plate member, and wherein said ripper tooth is pivotally mounted on said pin.

13. A bucket assembly according to claim 1 including a pair of transversely spaced ripper teeth, each connected to at least one of said walls for pivotal movement about an axis disposed substantially parallel to the axis of the pivotal connection of said bucket to said handle.

14. A bucket assembly according to claim 13 including a blade member interconnecting said pair of ripper teeth.

15. A bucket assembly according to claim 14 wherein said blade member is pivotal about an axis of a pivotal connection between said blade member and said ripper teeth.

16. A bucket assembly according to claim 13 wherein said restraining means comprise abutment surfaces engaged by said ripper teeth.

17. A bucket assembly according to claim 16 wherein said abutment surfaces are positioned relative to each other to permit an angular displacement of each of said ripper teeth within an arc of substantially 180°.

18. A bucket assembly according to claim 16 wherein each of said ripper teeth includes a shank section pivotally connected to said at least one wall, engageable with said abutment surfaces and a curved end section projecting beyond said bucket when said ripper tooth is disposed in said operative position.

19. A bucket assembly according to claim 13 wherein said releasable retaining means comprise magnetic devices.

20. A bucket assembly according to claim 13 wherein said releasable retaining means comprise permanent magnets supported on said bucket.

21. A bucket assembly according to claim 13 wherein said releasable retaining means comprise latch devices.

22. A bucket assembly according to claim 13 wherein each of said ripper teeth includes a protrusion disposed on a side thereof engage able with a stationery object when said ripper tooth is in its stored position and said bucket is pivoted relative to said handle, to cause said ripper tooth to angularly displace out of its stored position.

23. A bucket assembly according to claim 22 wherein said protrusion converges to a point enabling it to firmly engage said stationery object and correspondingly cause said ripper tooth to release from said retaining means.

24. A bucket assembly according to claim 13 wherein each of said ripper teeth is pivotally connected to a side wall of said bucket.

25. A bucket assembly according to claim 24 wherein portions of said side walls converge inwardly and rearwardly, including plate members rigidly mounted on said side walls and spaced from said converging portions thereof and pins interconnecting each converging wall section and an adjacent plate member, and wherein said ripper teeth are pivotally mounted on said pins.

26. In a machine having a handle, a bucket assembly mountable on said handle, comprising:

bucket pivotally mountable on said handle, including a pair of side walls having rearwardly and inwardly converging sections, plate members mounted on said side walls and spaced from said converging wall sections and transversely aligned pins disposed between and rigidly secured to said converging wall sections and said plate members;

a cutting implement having a pair of arm members each pivotally connected to one of said pins, and a transversely disposed blade member connected to end portions of said arm members;

means mounted on said bucket for restricting the angular displacement of said cutting implement between a storage position and an operating position; and means for retaining said cutting implement in at least one of said positions, operable upon causing a portion of said cutting implement to engage a stationery object and said bucket to pivot in a selected direction relative to said handle, to release said cutting implement.

27. A bucket assembly according to claim 26 wherein said arm members and a leading portion of said blade member are provided with sharpened edges.

* * * * *